United States Patent [19]

Hodder et al.

[11] Patent Number: 5,061,833

[45] Date of Patent: Oct. 29, 1991

[54] COMPACT DISCONNECT SWITCH HAVING BROADLY VARIABLE CURRENT RATING

[75] Inventors: George D. Hodder, Trafford; Edward D. Wallace, Pittsburgh, both of Pa.

[73] Assignee: Cleaveland/Price Inc., Trafford, Pa.

[21] Appl. No.: 15,486

[22] Filed: Feb. 9, 1987

Related U.S. Application Data

[63] Continuation of Ser. No. 809,509, Dec. 16, 1985, abandoned.

[51] Int. Cl.[5] ..... H01H 31/00

[52] U.S. Cl. ..... 200/255; 200/16 F; 200/48 KB; 200/48 R; 200/260; 200/282; 200/273; 200/570

[58] Field of Search ..... 200/162, 48 P, 48 A, 200/48 KB, 48 R, 164 R, 144 R, 252–256, 260, 155 R, 282, 271–274, 16 F

[56] References Cited

U.S. PATENT DOCUMENTS

| | | | |
|---|---|---|---|
| 2,303,119 | 11/1942 | Froland | 200/48 A |
| 2,644,864 | 7/1953 | Childs, Sr. | 200/155 R |
| 2,679,567 | 5/1954 | Kradel | 200/308 X |
| 3,118,990 | 1/1964 | Jansson | 200/255 X |
| 3,388,225 | 6/1968 | Foti | 200/48 A |
| 3,711,662 | 1/1973 | Kuhn | 200/48 A |
| 3,836,737 | 9/1979 | Redfern | 200/48 A |
| 4,001,530 | 1/1977 | Redfern | 200/48 A |
| 4,015,112 | 3/1977 | Castaldo | 200/155 R X |
| 4,105,878 | 8/1978 | Date et al. | 200/146 R |
| 4,339,626 | 7/1982 | Cleaveland et al. | 200/48 A |
| 4,379,956 | 4/1983 | Cleaveland et al. | 200/48 A |

FOREIGN PATENT DOCUMENTS

| | | | |
|---|---|---|---|
| 701274 | 1/1965 | Canada | 200/162 |
| 1024606 | 2/1958 | Fed. Rep. of Germany | 200/162 |

*Primary Examiner*—Ernest G. Cusick
*Attorney, Agent, or Firm*—W. D. Palmer

[57] ABSTRACT

Compact electrical power disconnect switch modularized to provide very broad current rating and comprising reverse-loop fingers which cooperate in pairs and form flexible spring-loaded contact members. An enlongated rotatable contact member is positioned between the reverse-loop fingers and makes and breaks electrical contact with same upon being rotated. Operation is fast and positive and three-phase power can readily be accommodated. A viewing window can be provided for a rapid check of the position of the switch.

21 Claims, 2 Drawing Sheets

COMPACT DISCONNECT SWITCH HAVING BROADLY VARIABLE CURRENT RATING

This is a continuation of co-pending application Ser. No. 06/809,509 filed on Dec. 16, 1985, abandond.

BACKGROUND OF THE INVENTION

This invention generally relates to electrical power disconnect switches and, more particularly, to a very compact disconnect switch which has a very broad current rating.

Present commercial switches specially designed for use with voltages less than about 5,000 volts and very high currents have traditionally been of the knife blade type which has a moving conductor hinged to open and close into a stationary contact. The problem with this design is that at very high current ratings, the moving conductor gets so large that it dictates an excessively large open gap for the low voltage rating. The low voltage open gap required to provide adequate electrical open clearance may be only one inch, but a knife blade conductor large enough to carry a typical 5,000 amp. load could not physically pivot on a hinge and be only one inch long. For these reasons, knife blade switches have traditionally been inefficient at such ratings because of blade length.

To avoid hinging the moving element of the switch, switches which utilize a "bridge" member have been used wherein a wedge-shaped bridge is forced into contact between two similarly shaped bus conductors. The bridge in such a switch makes a butt contact which has certain disadvantages.

Disconnect switches for use with higher voltages and used outdoors where ice breaking is essential have utilized reverse-loop contact members with a conductor member rotated against the contact members to provide a wiping contact opening action. Such switches have then moved the rotated contact member away from the loop contact members. Such a switch uses compression springs with the reverse-loop contact members. This construction is generally described in U.S. Pat. No. 4,339,636 dated July 13, 1982, to C. M. Cleaveland et al. A modified type of such a switch is shown in U.S. Pat. No. 4,379,956 dated Apr. 12, 1983, to C. M. Cleaveland et al. wherein an insulated spring connecting between two reverse-loop contact members provides the necessary contact tension. Again, such a device is normally used for higher voltage outdoor switch applications and after the circuit is opened, the rotatable contact member is pivoted away from the reverse-loop contact portions.

SUMMARY OF THE INVENTION

There is provided a compact electrical power disconnect switch for power applications of less than about 5,000 volts and having a very broad current rating. The switch comprises a plurality of electrically conducting strip-like members which have some degree of flexibility. Each strip-like member comprises a mounting portion and at least one elongated contact portion. The mounting portions of the members are affixed to insulating means which in turn are affixed to a supporting base, and electrical buses are adapted to be connected to the mounting portions. The contact portions of the strip-like members comprise elongated sections which are bent upwardly from the mounting portion and are then retroverted to form reverse-loop fingers which terminate in free ends and which have a limited dimension as measured in a direction perpendicular to the length dimension of the fingers. This ensures good contact capabilities for the fingers. Each of the reverse-loop fingers comprises one of a cooperating pair of such fingers with the respective free ends thereof facing each other and spaced apart a predetermined distance. Compression springs may be included between the retroverted-portions of the reverse-loop fingers proximate the free ends thereof.

An elongated member is rotatable on fixed bearings about an axis and is mounted parallel to the base of the switch and is spaced between the cooperating pairs of reverse-loop fingers. The rotatable member includes flattened electrically conducting contact means which are elongated in a direction transverse to the axis of the rotatable member. Insulating means is also associated with the rotating member to protect the user of the switch from electrical shock hazard. When the rotatable member is rotated to place the elongated flattened contact means in position parallel to the base, this conductor contacts the reverse-loop fingers to make good electrical contact therewith. When the rotatable member is rotated to place the flattened contact means in position perpendicular to the base, the flattened contact means is spaced a predetermined distance from the reverse-loop fingers to maintain an open circuit.

BRIEF DESCRIPTION OF THE DRAWINGS

For a better understanding of the invention, reference should be made to the accompanying drawings wherein.

DESCRIPTION OF THE PREFERRED EMBODIMENTS

Figure 1:
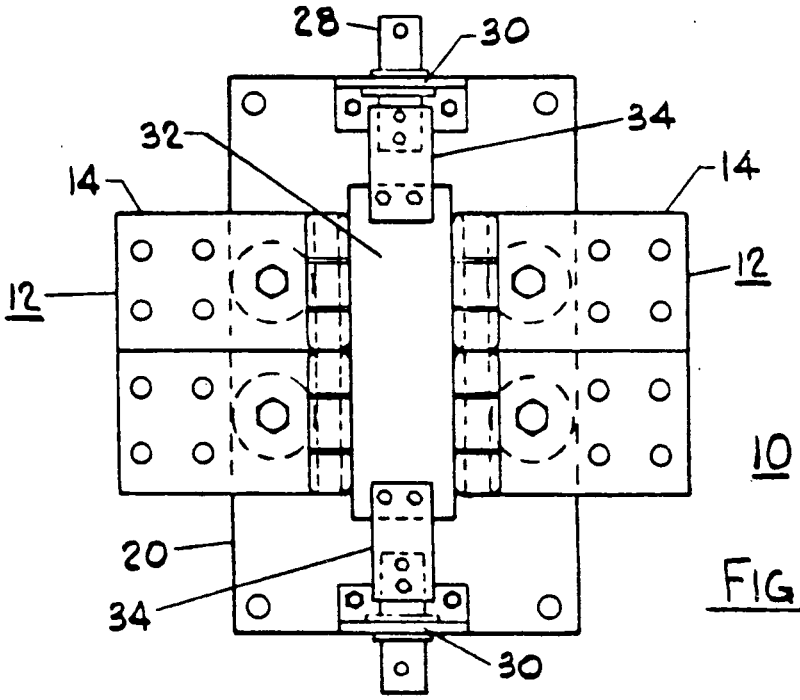
FIG. 1 is a plan view showing the internals of a preferred embodiment of the present switch.

With specific reference to the form of the invention illustrated in the drawings, the switch 10 in FIG. 1 is a compact disconnect switch for use in power applications having a voltage of less than about 5,000 volts and having a very broad current rating. The switch 10 comprises a plurality of electrically conducting strip-like members 12 which have a limited predetermined thickness so that they will display some degree of flexibility. As a specific example, each member 12 is formed of copper having a thickness of 0.25 inch (0.635 cm), a width of four inches (10.2 cm), and a total length of eighteen inches (45.8 cm). In the embodiment as shown, two of the strip-like members 12 which are combined as modules provide a current capacity rating of 2,400 amperes.

Figure 2:
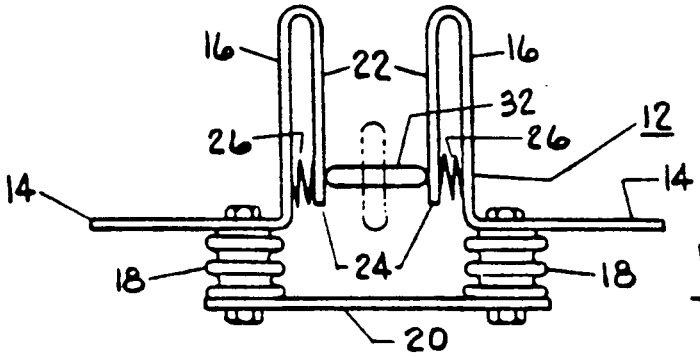
FIG. 2 is an elevational view showing one cooperating pair of reverse-loop fingers with the flattened elongated contact member shown in closed and open position.

As shown in FIG. 2, each of the strip-like members 12 comprise a mounting portion 14 and a contact portion 16. An electrical insulation member 18 connects the mounting portion 14 to a base member 20. The mounting portions 14 of the strip-like members 12 are adapted to have electrical buses (not shown) connected thereto.

As shown in FIG. 2, the contact portions 16 are bent upwardly with respect to the mounting portions 14 and are then retroverted to form reverse-loop fingers 22 which terminate in free ends 24. The reverse-loop fingers 22 have a limited dimension as measured in a direction perpendicular to the elongated length dimension of the fingers in order to ensure multiple electrical contact points for the reverse-loop fingers. As a specific example, the fingers each have a width dimension of 1.25 inches (3.2 cm). Each reverse-loop finger is spaced slightly from the adjacent fingers. The width dimension of the fingers 22 can be substantially varied.

As shown in FIG. 2, each of the reverse-loop fingers 22 is mounted to comprise one of a cooperating pair of fingers so that the free ends 24 of the fingers 22 are spaced apart a predetermined distance such as three inches (7.6 cm). Each of the reverse-loop fingers 22 has a compression spring 26 of predetermined strength positioned between the retroverted portions of the fingers 22 proximate the free ends 24 thereof.

Referring to FIG. 1, there is provided an elongated member 28 which is rotatable on fixed bearings 30 about an axis and mounted parallel to the base member 20 and evenly spaced between the spaced apart cooperating pairs of reverse-loop fingers 22. The rotatable member 28 includes a flattened electrically conducting contact means 32 which is elongated in a direction transverse to the axis of the rotatable member. In the embodiment as shown in FIG. 2, the member 32 is silver-plated copper with a width of 3.2 inches (8.1 cm) and a thickness of 0.5 inch (1.27 cm). The axial dimension of member 32 is sufficient to provide contact with all the reverse-loop fingers and in this case, the copper contact member has an axial dimension of 10 inches (25.4 cm). In its preferred form, the member 32 comprises a section of full round edge bus bar. The rotatable member 28 also includes insulation to protect the user of the switch from electrical shock hazard. In this embodiment, this is accomplished by fabricating the connecting member 34 of glass-polyester.

Figure 4:
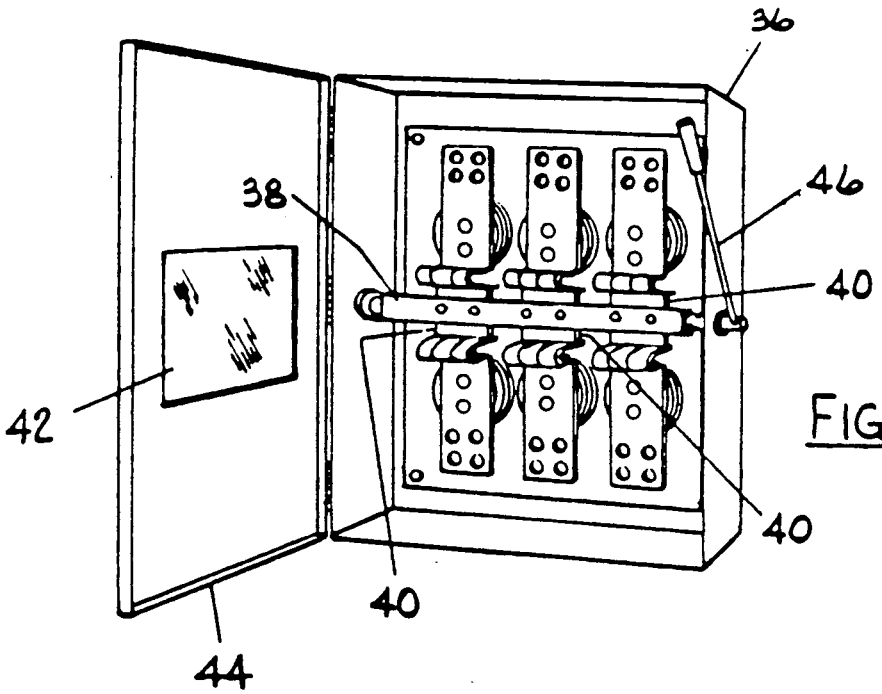
FIG. 4 is an isometric view of a completed switch embodiment which is operable with polyphase circuits and which includes an inspection window in the door portion.

A means is provided for facilitating the rotation of the member 28 to operate the switch and this can be accomplished by a handle, chain sprocket, or motor-driven worm, for example. A handle 46 for operating the switch is shown in FIG. 4.

In the operation of the embodiment as shown in FIGS. 1 and 2, the elongated contact means or member 32 in contacting, closed position is shown in solid lines and is parallel to the base 20. This flexes the fingers inwardly and somewhat compresses the springs 26. The spring strength can be varied but in this embodiment, a compressed spring pressure of 70 pounds has been found to be satisfactory. When the flattened contact member 32 is rotated to a position perpendicular to the base 20 as shown in dashed lines, the contact with the fingers 22 is opened and the switch is in open position.

Figure 3:
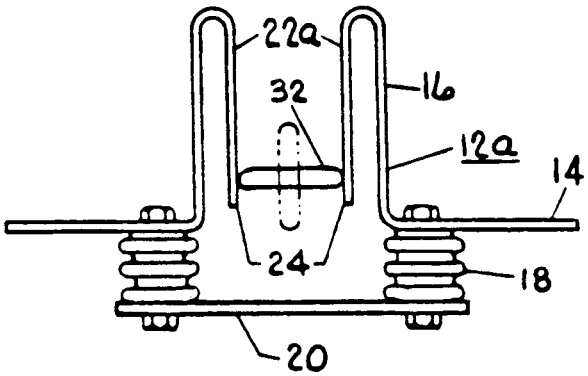
FIG. 3 is an elevational view showing an alternative embodiment of a cooperating pair of the reverse-loop fingers with the flattened elongated contact member shown in closed and open position.

The embodiment as shown in FIG. 3 is similar to the embodiment as shown in FIG. 2 except that the strip-like members 12*a* and thus the fingers 22*a* are formed of material which has spring-like characteristics so that the compression springs 26 can be dispensed with. As a specific example, in this embodiment the strip-like members can be fabricated of beryllium copper. In the foregoing embodiments, the rotatable contact member 32 engages the fingers 22 with a wiping action which maintains the contacts and fingers in a wiped clean condition. These embodiments are very versatile in current-carrying design since the individual strip-like members 12 can be used in modular fashion. As an example, a strip-like member 14 having a width of four inches (10.2 cm) is rated at 1600 amps. with a vented cabinet and a member having a width of twenty-eight inches (71.1 cm) is rated at 12,800 amps. with a vented cabinet. In this fashion, the rows of cooperating fingers can be lengthened or shortened to accommodate the desired current rating, with the greater the current rating, the larger the number of cooperating pairs of fingers required.

In the present switch design, the reverse-loop configuration of the fingers 22 operates in known fashion to increase the contact pressure during short circuit conditions due to the reverse-loop flow of the current and the magnetic fields resulting therefrom.

The present switch can be enclosed in a suitable case 36 as shown in FIG. 4. This embodiment is also modified somewhat in that each of the elongated strip-like members 12 is spaced from the nearest of these members and the three strip-like members can be used to disconnect polyphase power applications. In this embodiment, the rotatable member is formed as an elongated electrically insulating member 38 and three separate ones of the electrically conducting flattened contacts 40 are affixed to the member 38 and rotate therewith to open and close the polyphase circuit, in this case a three phase circuit.

The embodiment as shown in FIG. 4 also incorporates a window or viewing means 42 in the door portion 44 of the case 36 so that the open or closed status of the switch can be readily determined without opening the case. In other respects, the switch as shown in FIG. 4 is generally similar to the embodiments as previously described. While this embodiment has been shown for three-phase operation, it could readily be modified for other polyphase applications merely by providing a separate switch circuit for each separate circuit needed. These would be served by the single elongated insulating member 38 which in this embodiment is actuated by a handle 46. Each separate circuit would be operated by a separate contact member 40 carried on the insulating member 38.

Figure 5:
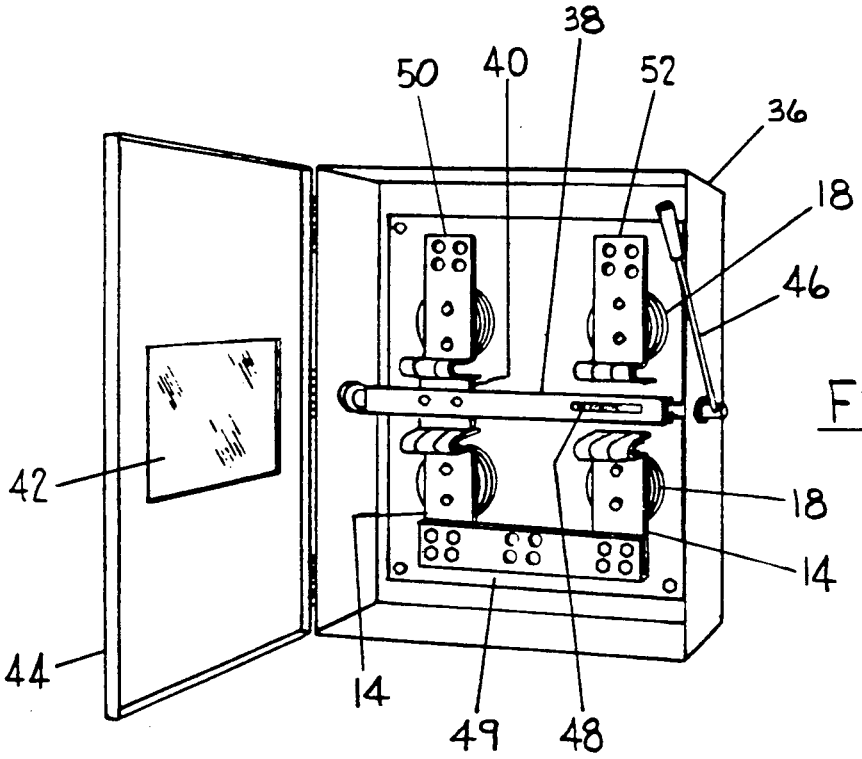
FIG. 5 is an isometric view of a switch embodiment which is designed to operate as a double-throw switch.

The present switch can also be modified to operate as a multiple-throw device and such an embodiment is shown in FIG. 5. This embodiment describes a double-throw switch although the number of circuits controlled can be increased if desired. With reference to FIG. 5, the switch design is generally as described in FIG. 4, except that the rotatable contact member 48 is positioned at right angles with respect to the contact member 40 and a common bus 49 connects the lower mounting sections 14. In this fashion, when the circuit controlled by the first assembly 50 is closed, the circuit controlled by the second assembly 52 is opened, and vice-versa, to provide the double-throw function.

The present switch has the following advantages: first, the contacts provide a true wiping action; second, the contacts are of the "blow-on" type due to the magnetic fields generated by the reverse-loop finger configuration; third, there is provided a visible air gap for an open switch; fourth, no push rods or secondary operating shafts are needed; and fifth, construction is very simple and inexpensive.

We claim as our invention:

1. A compact electrical power disconnect switch for use with power applications of less than about 5,000 volts and having a very broad current rating, said disconnect switch comprising:

a plurality of electrically conducting strip-like members which have a limited predetermined thickness so that they will display some degree of flexibility, each of said strip-like members comprising a mounting portion and at least one elongated contact portion, electrical insulating mounting means to which the mounting portions of said strip-like members are affixed, a base member to which said insulating mounting means are affixed, said mounting portions of said strip-like members adapted to have electrical buses connected thereto, said contact portions of said strip-like members each comprising elongated sections which are bent upwardly with respect to said mounting portions and are then retroverted to form retroverted reverse-loop finger portions which terminate in free ends, and said contact portions of said strip-like members having a limited width dimension as measured in a direction perpendicular to the elongated length dimension of said contact portions of said strip-like members in order to ensure good electrical contact; each of said retroverted reverse-loop finger portions being mounted opposite another of said retroverted reverse-loop finger portions to form a cooperating pair of said retroverted reverse-loop finger portions facing each other and spaced apart a predetermined distance and electrically insulated from each other when said switch is open, and each of said retroverted reverse-loop finger portions having compression spring means of predetermined strength positioned between said retroverted reverse-loop finger portions proximate the free ends thereof;

an elongated member rotatable on fixed bearings about an axis and mounted parallel to said base and between said spaced apart retroverted reverse-loop finger portions, said rotatable member including an electrically conducting contact means of generally flattened configuration and which is elongated in one dimension which is transverse to the axis of said elongated rotatable member, and said rotatable member also including insulating means to protect the user of said switch from electrical shock hazard; and means for facilitating the rotation of said rotatable member to operate said switch; when said rotatable member is rotated to wipe along the length dimension of said contact portions and place said flattened contact means in position parallel to said base, said flattened contact means makes simultaneous electrical contact with said oppositely disposed retroverted reverse-loop finger portions proximate the free ends thereof and somewhat compresses said compression spring means; and when said rotatable member is rotated to place said flattened contact means in position perpendicular to said base, said flattened contact means is spaced a predetermined distance from both said oppositely disposed retroverted reverse-loop finger portions to maintain an open circuit.

2. The switch as specified in claim 1, wherein a multiplicity of said cooperating pairs of said retroverted reverse-loop finger portions are disposed in rows on either side of said rotatable member to achieve a desired current rating with the greater the current rating, the greater the number of said cooperating pairs of said retroverted reverse-loop finger portions.

3. The switch as specified in claim 1, wherein said switch is enclosed by a protective case, and a window means is provided in said case to enable an operator to visually observe the open or closed status of said switch.

4. The switch as specified in claim 1, wherein said elongated rotatable member comprises an elongated electrically insulating member, and said electrically conducting flattened contact means is affixed to said elongated insulating member to rotate therewith.

5. The switch as specified in claim 1, wherein said electrically conducting flattened contact means comprises a portion of a full round edge bus bar.

6. The switch as specified in claim 1, wherein said retroverted reverse-loop finger portions when engaged and disengaged by said rotatable contact means are wiped clean during electrical make and break by the rotating action of said rotatable contact means.

7. The switch as specified in claim 1, wherein the retroverted reverse-loop shape of said finger portions provides high contact pressure with said flattened contact means during short circuit conditions.

8. A compact electrical power disconnect switch for use with power applications of less than about 5,000 volts and having a very broad currect rating, said disconnect switch comprising:

a plurality of electrically conducting strip-like members which have a limited predetermined thickness so that they will display some degree of flexibility, each of said strip-like members comprising a mounting portion and at least one elongated contact portion, electrical insulating mounting means to which the mounting portions of said strip-like members are affixed, a base member to which said insulating mounting means are affixed, said mounting portions of said strip-like members adapted to have electrical buses connected thereto, said contact portions of said strip-like members each comprising elongated sections which extend from said mounting portions and are then retroverted to form retroverted reverse-loop finger portions which teminate in free ends, and said contact portions of said strip-like members having a limited width dimension as measured in a direction perpendicular to the elongated length dimension of said contact portions of said strip-like members in order to ensure good electrical contact;

each of said retroverted reverse-loop finger portions being mounted opposite another of said retroverted reverse-loop finger portions with the free ends of each of said cooperating pair of said retroverted reverse-loop finger portions facing each other and spaced apart a predetermined distance and electrically insulated from each other when said switch is open, and each of said retroverted reverse-loop finger portion having spring-like characteristics;

an elongated member rotatable on fixed bearings about an axis and mounted parallel to said base and between said spaced apart retroverted reverse-loop finger portions, said rotatable member including an electrically conducting contact means of generally flattened configuration and which is elongated in one dimension which is transverse to the axis of said elongated rotatable member, and said rotatable member also including insulating means to protect the user of said switch from electrical shock hazard; and means for facilitating the rotation of said rotatable member to operate said switch; when said rotatable member is rotated to wipe along the length dimension of contact portions and place said flattened contact means in position parallel to said base, said flattened contact means makes simultaneous electrical contact with said oppositely disposed retroverted reverse-loop finger portions proximate the free ends thereof and moves said finger portions against their spring-like characteristics; and when said rotatable member is rotated to place said flattened contact means in position perpendicular to said base, said flattened contact means is spaced a predetermined distance form both said oppositely disposed retroverted reverse-loop finger portions to maintain an open circuit.

9. The switch as specified in claim 8, wherein a multiplicity of said cooperating pairs of said retroverted reverse-loop finger portions are disposed in rows on either side of said rotatable member to achieve a desired current rating with the greater the current rating, the greater the number of said cooperating pairs of said retroverted reverse-loop finger portions.

10. The switch as specified in claim 8, wherein said switch is enclosed by a protective case, and a window means is provided in said case to enable an operator to visually observe the open or closed status of said switch.

11. The switch as specified in claim 8, wherein said elongated rotatable member comprises an elongated electrically insulating member, and said electrically conducting flattened contact means is affixed to said elongated insulating member to rotate therewith.

12. The switch as specified in claim 8, wherein said flattened contact means comprises a portion of a full round edge bus bar.

13. The switch as specified in claim 8, wherein said flexible retroverted reverse-loop finger portions when engaged and disengaged by said rotatable contact means are wiped clean during electrical make and break by the rotating action of said rotatable contact means.

14. The switch as specified in claim 8, wherein the reverse-loop shape of said retroverted finger portions provides high contact pressure with said flattened contact means during short circuit conditions.

15. A compact electrical power disconnect switch for use with polycircuit power applications of less than about 5,000 volts and having a very broad current rating, said disconnect switch comprising:

a separate switch circuit provided for each circuit, each of said circuits comprising a plurality of electrically conducting strip-like members which have a limited predetermined thickness so that they will display some degree of flexibility, each of said strip-like members comprising a mounting portion and at least one elongated contact portion, electrical insulating mounting means to which the mounting portions of said strip-like members are affixed, a base member to which said insulating mounting means are affixed, said mounting portions of said strip-like members adapted to have electrical buses connected thereto, said contact portions of said strip-like members each comprising elongated sections which extend from said mounting portions and are then retroverted to form retroverted reverse-loop finger portions which terminate in free ends, and said contact portions of said strip-like members having a limited width dimension as measured in a direction perpendicular to the elongated length dimension of said contact portions of said strip-like members in order to ensure good electrical contact;

each of said retroverted reverse-loop finger portions being mounted opposite another of said retroverted reverse-loop finger portions to form a cooperating pair of said retroverted reverse-loop finger portions with the free ends of each of said cooperating pair of said retroverted reverse-loop finger portions facing each other and spaced apart a predetermined distance and electrically insulated from each other when said switch is open, and each of said retroverted reverse-loop finger portions having a compression spring means of predetermined strength positioned between the retroverted portions of said reverse-loop finger portions proximate the free ends thereof;

a single elongated electrically insulating member rotatable on fixed bearings about an axis and mounted parallel to said base and between said spaced apart retroverted reverse-loop finger portions, said rotatable member having mounted thereon spaced apart electrically conducting contact means of generally flattened configuration and which are elongated in a dimension which is transverse to the axis of said elongated rotatable member; and means for facilitating the rotation of said rotatable member to operate said switch; when said rotatable member is rotated to wipe along the length dimension of said contact portions and place said flattened contact means in position parallel to said base, said flattened contact means make simultaneous electrical contact with said oppositely disposed retroverted reverse-loop finger portions proximate the free ends thereof and somewhat compress said compression spring means to close the separate switch circuits; and when said rotatable member is rotated to place said flattened contact means in position perpendicular to said base, said flattened contact means are spaced a predetermined distance from both said oppositely disposed retroverted reverse-loop finger portions to maintain an open circuit.

16. The switch as specified in claim 15, wherein said switch is operable with three-phase power applications, said switch including three separate conducting circuits each of which comprise a plurality of said strip-like members which comprise a mounting portion and contact portion formed as retroverted reverse-loop finger portions, said elongated rotatable member comprising an elongated electrically insulating member, and three separate ones of said flattened electrically conducting means are affixed to said elongated insulating member to rotate therewith to make and break contact with said three separate conducting circuits.

17. The switch as specified in claim 15, wherein said switch operates as multiple-throw device, separate circuits are included in said switch, and each of said circuits comprise said cooperating pairs of said retroverted reverse-loop finger portions, said single elongated rotatable electrically insulating member has affixed thereto one of said spaced apart electrically conducting contact means for each said separate circuit, and said electrically conducting contact means are positioned at an angle with respect to each other so that said separate circuits can be alternately energized and deenergized.

18. A compact electrical power disconnect switch for use with power applications of less than about 5,000 volts and having a very broad current rating, said disconnect switch comprising:

a plurality of electrically conducting mounting portions, electrical insulating mounting means to which said mounting portions are affixed, a base member to which said insulating mounting means are affixed, said mounting portions adapted to have electrical buses connected thereto, a plurality of elongated contact portions which display some degree of flexibility, said contact portions supported by and electrically connected to said mounting portions, said contact portions extend from said mounting portions and are then retroverted to form retroverted reverse-loop finger portions which terminate in free ends, and said contact portions having a limited width dimension as measured in a direction perpendicular to the elongated length dimension of said contact portions in order to ensure good electrical contact; each of said retroverted reverse-loop finger portions being mounted opposite another of said retroverted reverse-loop finger portions to form a cooperating pair of said retroverted reverse-loop finger portions with the free ends of each of said cooperating pair of said retroverted reverse-loop finger portions facing each other and spaced apart a predetermined distance and electrically insulated from each other when said switch is open, and each of said retroverted reverse-loop finger portions having spring-like characteristics;

an elongated member rotatable on fixed bearings about an axis and mounted parallel to said base and between said spaced apart retroverted reverse-loop finger portions, said rotatable member including an electrically conducting contact means of generally flattened configuration and which is elongated in one dimension which is transverse to the axis of said elongated rotatable member, and said rotatable member also including insulating means to protect the user of said switch from electrical shock hazard;

means for facilitating the rotation of said rotatable member to operate said switch; in order to close said switch, said rotatable member is rotated to wipe along the length dimension of said contact portions and place said flattened contact means in simultaneous electrical contact with said oppositely disposed retroverted reverse-loop finger portions proximate the free ends thereof to move said retroverted reverse-loop finger portions against their spring-like characteristics; and in order to open said switch, said rotatable member is rotated to provide a predetermined spacing between said flattened contact means and both said oppositely disposed retroverted reverse-loop finger portions; and a multiplicity of said cooperating pairs of said retroverted reverse-loop finger portions are disposed in rows on either side of said rotatable member with the greater the current rating of said switch, the greater the number of said cooperating pairs of said retroverted reverse-loop finger portions.

19. The switch as specified in claim 18; wherein each of said retroverted reverse-loop finger portions has compression spring means of predetermined strength positioned between said retroverted reverse-loop finger portions proximate the free ends thereof; and in order to close said switch, said rotatable member is rotated to place said flattened contact means in electrical contact with said oppositely disposed retroverted reverse-loop finger portions proximate the free ends thereof to somewhat compress said compression spring means.

20. A compact electrical power disconnect switch for use with power applications of less than about 5,000 volts and having a very broad current rating, said disconnect switch comprising:

a plurality of electrically conducting mounting portions, electrical insulating mounting means to which said mounting portions are affixed, a base member to which said insulating mounting means are affixed, said mounting portions adapted to have electrical buses connected thereto, a plurality of elongated contact portions which display some degree of flexibility, said contact portions supported by and electrically connected to said mounting portions, said contact portions extend from said mounting portions and are then retroverted to form retroverted reverse-loop finger portions which terminate in free ends, and said contact portions having a limited width dimension as measured in a direction perpendicular to the elongated length dimension of said contact portions in order to ensure good electrical contact; each of said retroverted reverse-loop finger portions being mounted opposite another of said retroverted reverse-loop finger portions to form a cooperating pair of said retroverted reverse-loop finger portions with the free ends of each of said cooperating pair of said retroverted reverse-loop finger portions facing each other and spaced apart a predetermined distance and electrically insulated from each other when said switch is open, and each of said retroverted reverse-loop finger portions having spring-like characteristics;

an elongated member having a rotation axis and being rotatable on fixed bearings about its axis, said axis positioned between said spaced apart retroverted reverse-loop finger portions, said rotatable member including an electrically conducting contact means of generally flattened configuration and which is elongated in one dimension which is transverse to said axis of said elongated rotatable member, and said rotatable member also including insulating means to protect the user of said switch from electrical shock hazard;

means for facilitating the rotation of said rotatable member to operate said switch; in order to close said switch, said rotatable member is rotated to wipe along the length dimension of said contact portions and place said flattened contact means in simultaneous electrical contact with said oppositely disposed retroverted reverse-loop finger portions proximate the free ends thereof to move said retroverted reverse-loop finger portions against their spring-like characteristics; and in order to open said switch, said rotatable member is rotated to provide a predetermined spacing between said flattened contact means and both said oppositely disposed retroverted reverse-loop finger portions; and a multiplicity of said cooperating pairs of said retroverted reverse-loop finger portions are disposed in rows on either side of said rotatable member with the greater the current rating of said switch, the greater the number of said cooperating pairs of said retroverted reverse-loop finger portions.

21. The switch as specified in claim 20; wherein each of said retroverted reverse-loop finger portions has compression spring means of predetermined strength positioned between said retroverted reverse-loop finger portions proximate the free ends thereof; and in order to close said switch, said rotatable member is rotated to place said flattened contact means in electrical contact with said oppositely disposed retroverted reverse-loop finger portions proximate the free ends thereof to somewhat compress said compression spring means.

* * * * *